US011878203B1

(12) United States Patent
Meneve, Jr.

(10) Patent No.: US 11,878,203 B1
(45) Date of Patent: Jan. 23, 2024

(54) SAFE WEIGHT LIFTING

(71) Applicant: Russell David Meneve, Jr., New York, NY (US)

(72) Inventor: Russell David Meneve, Jr., New York, NY (US)

( * ) Notice: Subject to any disclaimer, the term of this patent is extended or adjusted under 35 U.S.C. 154(b) by 0 days.

(21) Appl. No.: 18/074,391

(22) Filed: Dec. 2, 2022

Related U.S. Application Data

(60) Provisional application No. 63/429,787, filed on Dec. 2, 2022.

(51) Int. Cl.
*A63B 21/078* (2006.01)

(52) U.S. Cl.
CPC ..... *A63B 21/0783* (2015.10)

(58) Field of Classification Search
CPC ..... A63B 21/072; A63B 21/0724; A63B 21/0726; A63B 21/0728; A63B 21/075; A63B 21/078; A63B 21/0783; A63B 21/151; A63B 21/153; A63B 21/154; A63B 21/157; A63B 21/158
See application file for complete search history.

(56) References Cited

U.S. PATENT DOCUMENTS 5,989,164 A * 11/1999 Kullman ..... A63B 21/0783 482/93
6,537,182 B2 * 3/2003 Slawinski ..... A63B 21/0783 482/4
2012/0244999 A1 * 9/2012 Tauriainen ..... A63B 21/078 482/104
2020/0023226 A1 * 1/2020 Silveira ..... A63B 21/0626
2020/0087119 A1 * 3/2020 Friessen ..... A63B 21/0783
2020/0188719 A1 * 6/2020 Brand ..... A63B 21/4029
2020/0376321 A1 * 12/2020 Davis ..... A63B 71/0054
2022/0212054 A1 * 7/2022 Yang ..... A63B 24/0087
2023/0009699 A1 * 1/2023 Ferlito ..... A63B 21/0552

OTHER PUBLICATIONS

Bengtsson et al., "Narrative review of injuries in powerlifting with special reference to their association to the squat, bench press and deadlift," BMJ Open Sport & Exercise Medicine, Jul. 17, 2018, 4(1), 8 pages.

Pollok [online], "What Injuries Can You Get from Deadlifting?" My Powerlifting Life, retrieved on Dec. 9, 2022, retrieved from URL <http://powerlifting.life/what-injuries-can-you-get-from-deadlifting>, Apr. 17, 2020, 5 pages.

* cited by examiner

*Primary Examiner* — Sundhara M Ganesan
*Assistant Examiner* — Zachary T Moore
(74) *Attorney, Agent, or Firm* — Fish & Richardson P.C.

(57) ABSTRACT

A weightlifting system includes a locking mechanism comprising a receiver, a storage that places tension on a flexible member, the flexible member being connected to the storage and to a weight of the weightlifting system, wherein the flexible member extends through the locking mechanism such that when the locking mechanism is locked, a length of the flexible member extending from the locking mechanism is fixed, and a first trigger device connected to a weight of the weightlifting system, wherein the first trigger device is operable by a user to send a first signal to the receiver to unlock the locking mechanism, wherein the locking mechanism is configured to unlock based upon receiving the signal from the first trigger device and upon a movement of the weight of the weightlifting system.

30 Claims, 9 Drawing Sheets

SAFE WEIGHT LIFTING

TECHNICAL FIELD

This disclosure relates to weight lifting.

BACKGROUND

Weightlifting is a common type of training for developing the strength and size of muscles. Injuries can occur during weightlifting. For example, spinal injuries (e.g., lumbosacral injuries) are a common type of deadlifting injury. Hip injuries are also common among deadlifting injuries.

SUMMARY

The present systems and methods provide safety features to reduce injuries while weightlifting. For example, a weightlifting safety system can provide a bar having weights at both ends of the bar for a user to lift. When the user lets go of the bar, the safety system can automatically lock a locking feature. The weight (e.g., bar and connected weights) maintains its position (e.g., hangs in free space) when the locking feature is locked, allowing the user to step away from the weight and avoid injury. When the user desires to resume weightlifting, the user can unlock the locking feature by grabbing onto the weight and resuming the lifting motion. The provided systems and methods can be used for a variety of free weights, gym configurations, physical therapy tools, industrial usages, etc. The present systems and methods can be also used for mounting to a variety of surfaces, e.g., using a single point mounting setup, a dual point mounting setup, a multi-mounting point setup, etc.

In an aspect, a weightlifting system includes a locking mechanism including a receiver, a storage that places tension on a flexible member, the flexible member being connected to the storage and to a weight of the weightlifting system, wherein the flexible member extends through the locking mechanism such that when the locking mechanism is locked, a length of the flexible member extending from the locking mechanism is fixed, and a first trigger device connected to a weight of the weightlifting system, wherein the first trigger device is operable by a user to send a first signal to the receiver to unlock the locking mechanism, wherein the locking mechanism is configured to unlock based upon receiving the signal from the first trigger device and upon a movement of the weight of the weightlifting system.

In some embodiments, the first trigger device includes a pushbutton operable to send the signal to the locking mechanism to unlock the locking mechanism.

In some embodiments, the first trigger device includes an ultrasonic sensor operable to send the signal to the locking mechanism to unlock the locking mechanism.

In some embodiments, the first trigger device includes a laser operable to send the signal to the locking mechanism to unlock the locking mechanism.

In some embodiments, the first trigger device includes a proximity sensor operable to send the signal to the locking mechanism to unlock the locking mechanism.

In some embodiments, the locking feature is a mechanical rope lock that includes an electric solenoid configured to unlock based upon receiving the signal from the first trigger device.

In some embodiments, the system includes a power source configured to provide power to the locking mechanism.

In some embodiments, the first trigger device is operable to send the first signal to the receiver wirelessly.

In some embodiments, the first trigger device is operable to send a second signal to lock the locking mechanism.

In some embodiments, the movement of the weight that unlocks the locking mechanism is a vertical movement.

In another aspect, a weightlifting system includes a barbell, a mount operable to mount the weightlifting system, a locking mechanism including a receiver, the locking mechanism positioned on the mount, a flexible member that is connected to the barbell, wherein the flexible member extends through the locking mechanism such that when the locking mechanism is locked, a length of the flexible member extending from the locking mechanism is fixed, a storage component positioned on the mount, wherein the storage component places constant tension on the flexible member, a pulley positioned on the mount between the storage component and the locking mechanism, wherein the flexible member extends from the storage component, around the pulley, and through the locking mechanism, a first trigger device connected to the barbell, wherein the first trigger device is operable by a user to send a first signal to the receiver to unlock the locking mechanism, wherein the locking mechanism is configured to unlock based upon receiving the signal from the first trigger device and upon a vertical movement of the barbell.

In some embodiments, the first trigger device includes a pushbutton operable to send the signal to the locking mechanism to unlock the locking mechanism.

In some embodiments, the first trigger device includes an ultrasonic sensor operable to send the signal to the locking mechanism to unlock the locking mechanism.

In some embodiments, the first trigger device includes a laser operable to send the signal to the locking mechanism to unlock the locking mechanism.

In some embodiments, the first trigger device includes a proximity sensor operable to send the signal to the locking mechanism to unlock the locking mechanism.

In some embodiments, the locking feature is a mechanical rope lock that includes an electric solenoid configured to unlock based upon receiving the signal from the first trigger device.

In some embodiments, the system includes a power source configured to provide power to the locking mechanism.

In some embodiments, the first trigger device is operable to send the first signal to the receiver wirelessly.

In some embodiments, the first trigger device is operable to send a second signal to lock the locking mechanism.

In some embodiments, the flexible member is a first flexible member and the system further includes a second flexible member extending through a second locking mechanism and connected to a side of the barbell that is opposite the first flexible member.

In another aspect, a weightlifting system includes a locking mechanism including a receiver, the locking mechanism being operable to lock such that a length of a flexible member extending through the locking mechanism is fixed, and a first trigger device operable by a user to send a first signal to the receiver to unlock the locking mechanism such that the flexible member is free to move through the locking mechanism, wherein the locking mechanism is configured to unlock based upon receiving the signal from the first trigger device and upon a predetermined movement of flexible member through the locking mechanism.

In some embodiments, the first trigger device includes a pushbutton operable to send the signal to the locking mechanism to unlock the locking mechanism.

In some embodiments, the first trigger device includes an ultrasonic sensor operable to send the signal to the locking mechanism to unlock the locking mechanism.

In some embodiments, the first trigger device includes a laser operable to send the signal to the locking mechanism to unlock the locking mechanism.

In some embodiments, the first trigger device includes a proximity sensor operable to send the signal to the locking mechanism to unlock the locking mechanism.

In some embodiments, the locking feature is a mechanical rope lock that includes an electric solenoid configured to unlock based upon receiving the signal from the first trigger device.

In some embodiments, the system includes a power source configured to provide power to the locking mechanism.

In some embodiments, the first trigger device is operable to send the first signal to the receiver wirelessly.

In some embodiments, the first trigger device is operable to send a second signal to lock the locking mechanism.

In some embodiments, the predetermined movement of the flexible member is a movement in a predetermined direction.

The details of one or more embodiments of the subject matter described herein are set forth in the accompanying drawings and the description below. Other features, objects, and advantages of the subject matter will be apparent from the description and drawings, and from the claims.

DESCRIPTION OF DRAWINGS

Like reference numbers and designations in the various drawings indicate like elements.

DETAILED DESCRIPTION

Figure 2:
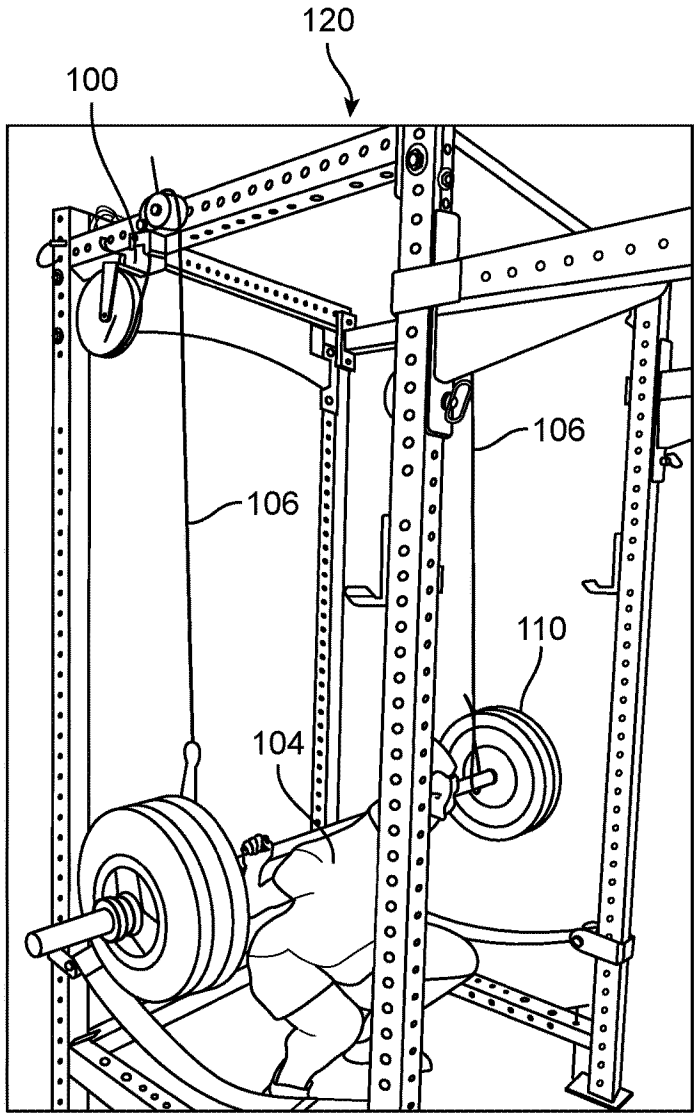
FIGS. 1-4 are a series of images that illustrate a weightlifting safety system that is engaged by a user to hold a weight.

The present systems and methods provide safety features to reduce injuries while weightlifting. For example, a weightlifting safety system can provide a bar having weights at both ends of the bar for a user to lift. The weight (e.g., bar and connected weights) maintains its position (e.g., hangs in free space) when a locking feature of the safety system is locked. The user can lock the locking feature by simply releasing the weight. The user can then step away from the weight and avoid injury. The user can unlock the locking feature again by grabbing onto the weight and resuming the lifting motion.

FIGS. 1-4 are a series of images captured that illustrates a user initiating a weightlifting motion and engaging a weightlifting safety system to allow a weight to be locked in place, thereby allowing the user to step away. A weightlifting safety system 100 is mountable to a squat rack 102. The safety system 100 can be easily attached to the squat rack 102 so that a user 104 can adjust the position of the safety system 100 or move the safety system 100 to a different rack. The safety system 100 includes two ropes 106 that attach to either side of a barbell 108. The barbell 108 includes weights 110 on either side of the barbell. Scanning the images, the user 104 is doing a squat exercise using the barbell 108. Generally, the user can unlock the locking feature of the weightlifting safety system 100 by grabbing the barbell 108 and lifting the barbell 108. The user 104 can lock the locking feature of the weightlifting safety system 100 by releasing the barbell 108. The barbell 1108 is free to move when the locking feature of the weightlifting safety system 100 is unlocked. For example, the locking feature is unlocked while the user 102 holds the barbell 108. The barbell 108 locks in place (e.g., maintains its position) when the locking feature is locked. For example, the locking feature is locked when the user 104 releases the barbell 1048. This allows the user to step away from the weight when desired, avoid injury, etc.

Figure 1:
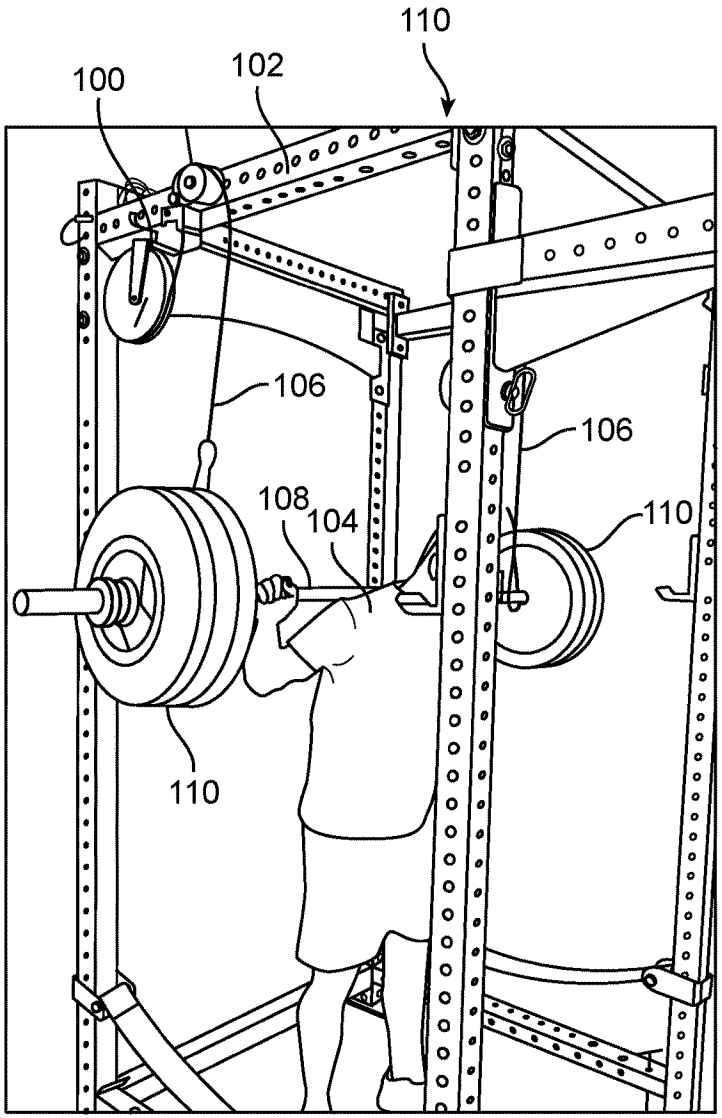
Figure 4:
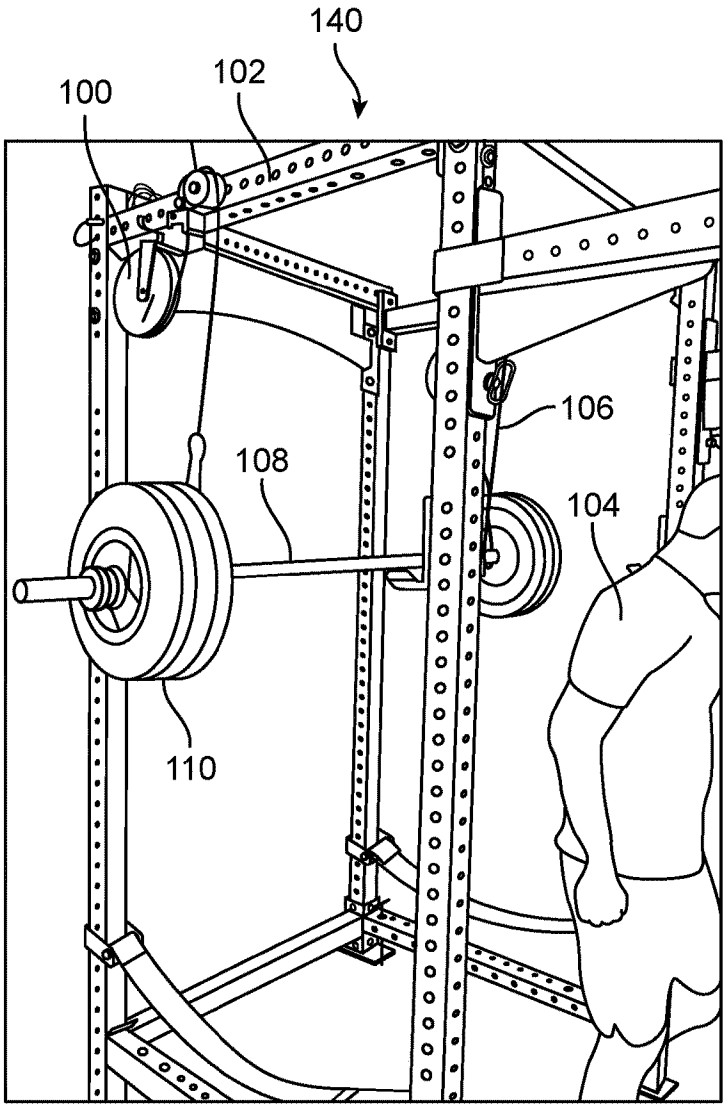
Figure 3:
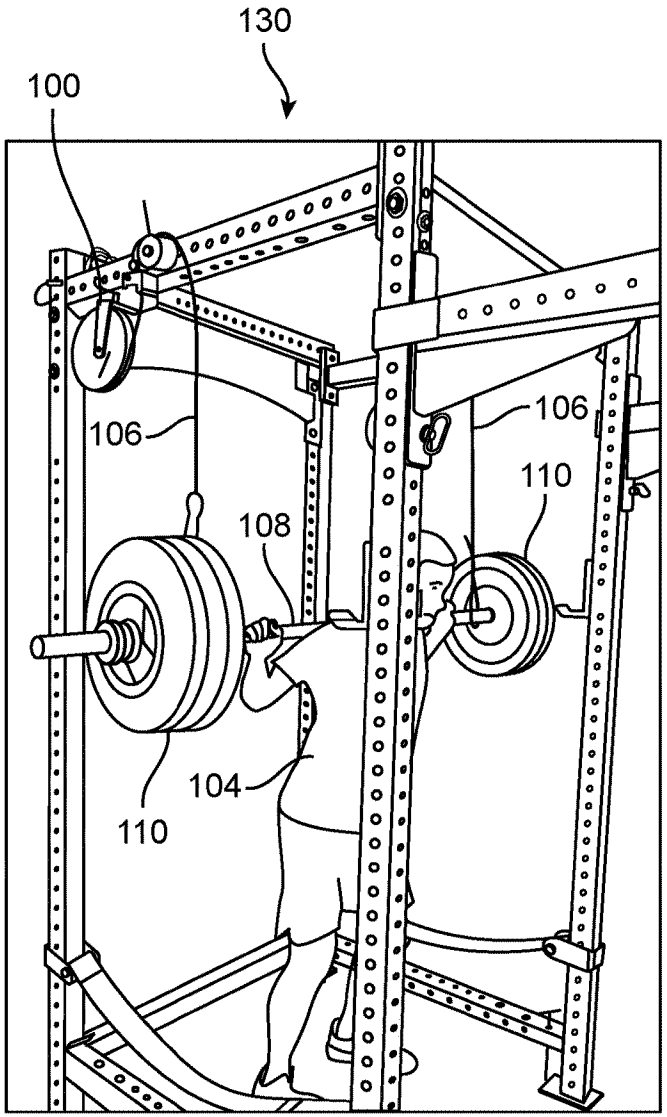

For example, in FIG. 1, the scene 110 shows the user 104 holding the barbell 108 and standing with the barbell 108 on his shoulders. In FIG. 2, the scene 120 shows the user 104 continuing to hold the barbell 108 and squatting down to exercise his legs. The barbell 108 continues to remain on the shoulders of the user 104 while the user squats because the barbell 108 is free to move in all directions (e.g., multiple degrees of freedom) when the locking feature is unlocked. For example, the ropes 106 can extend and retract because the locking feature is unlocked while the user 104 holds the barbell 108. The user 104 can also do other exercises (e.g., shoulder press, hang clean, deadlift, etc.) because the barbell 108 is free to move when the locking feature is unlocked. In FIG. 3, the scene 130 shows the user 104 upwardly extending his legs so he is standing again. The ropes 106 retract and the barbell 108 moves with the user 104 when the locking feature is unlocked. The locking feature remains unlocked because the user 104 is still holding the barbell 108. In FIG. 4, the user 104 has decided to halt the exercise and move free of the squat rack 102. The user's act of releasing the barbell 108 triggers the safety system 100 to lock the locking feature of the safety system 100. The barbell 108 maintains its position because the locking feature of the safety system 100 is locked. For example, the ropes 106 do not extend from the safety system 100 because the locking feature is locked. The ropes 106 hold the barbell 108 while the user 104 steps away, e.g., to avoid injury, finish the exercise, change weights, etc.

When the user 104 wants to resume exercising using the weight 104 (e.g., the user stepped away for a towel, drink, etc.), the user can unlock the safety system 100, e.g., by grabbing the barbell 108 and vertically lifting the barbell 108 slightly. For example, the user can lift the barbell 108 as part of the motion of resuming squatting with the barbell 108 on his shoulders. Although the user in FIGS. 1-4 is illustrated as squatting, the safety system 100 can be incorporated into various types of lifting equipment and systems, e.g., because the safety system 100 is mountable to the equipment and can easily be moved. For example, the safety system 100 can be used for different machines made by different manufacturers. The safety system 100 can be used to mount to a variety of surfaces and can be used in a variety of systems including, e.g., recreational systems, industrial systems, etc. The safety system can be incorporated into lifting equipment used for a number of exercises, e.g., bench press, rack pull, deadlift, rows, push press, hip thrust, hang clean, etc. because the weight 104 is free to move with multiple degrees of freedom while the system is unlocked.

Figure 5:
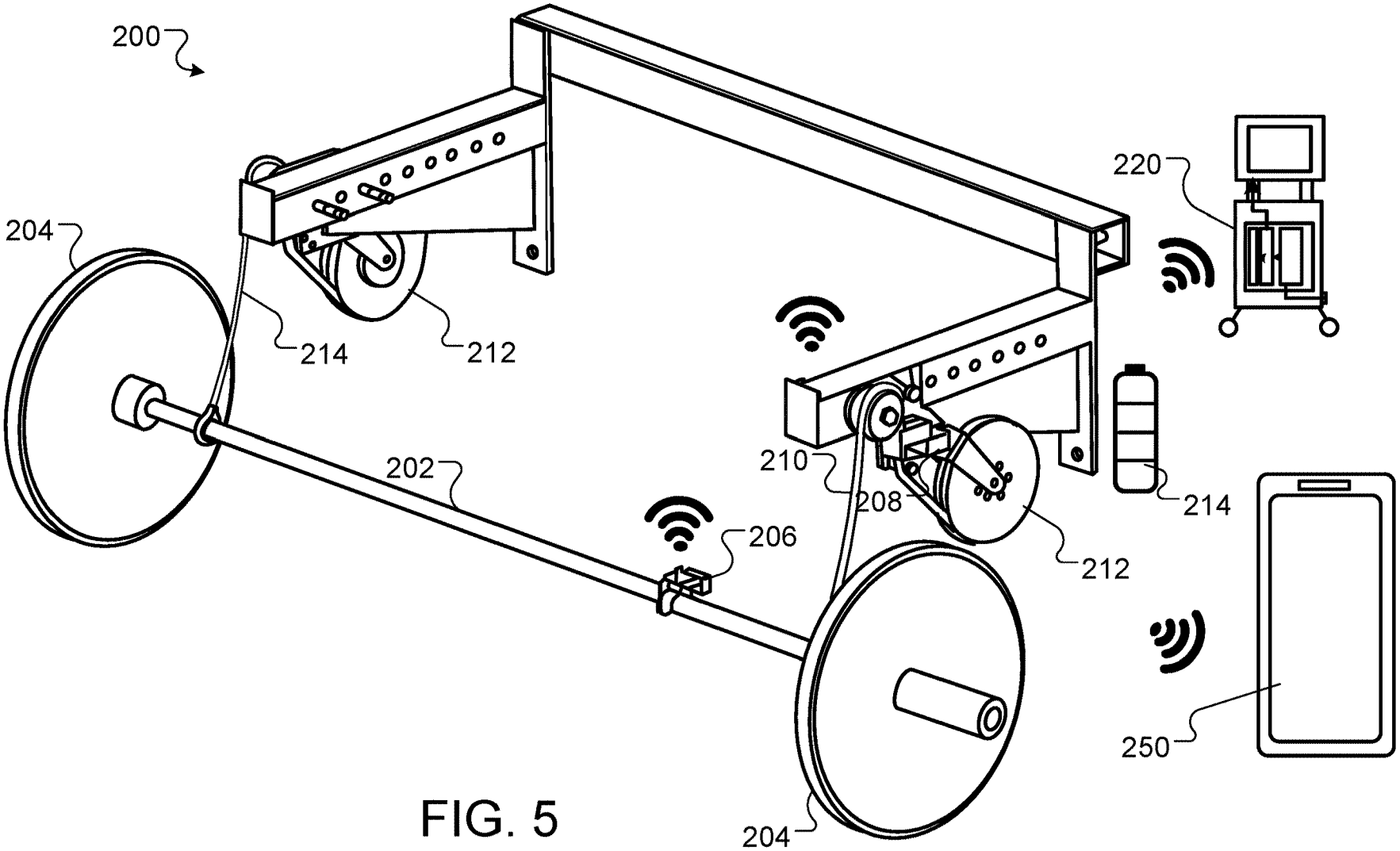
FIG. 5 is a perspective view of components of a weightlifting safety system.

FIG. 5 illustrates a perspective view of a weightlifting safety system 200. The weightlifting safety system 200 can be easily mountable to existing equipment (e.g., squat racks, benches, etc.). The weightlifting safety system 200 is one example of a system that can be used similar to the safety system 100 of FIG. 1. A barbell 202 includes weights 204 on either side of the barbell 202. In other implementations, any of a variety of weights used for weightlifting (e.g., dumbbells, kettlebells, etc.) can be used in addition or alternatively to the barbell 202. The barbell 202 includes a trigger device 206 that is operable by a user to lock and unlock the locking features 208 of the safety system. For example, the illustrated embodiment includes a locking feature on either side of the system 200. The trigger device 206 can include can employ different types of technology (e.g., mechanical, magnetic, electromagnetic, etc.) to determine whether the user is holding the barbell 206. For example, the trigger device 206 can include a mechanical pushbutton that the user presses when holding the barbell 202. In another example, the trigger device 206 can include a proximity sensor can employ magnetic signals (e.g., capacitive signals, photoelectric signals, induction, etc.). In some implementations, the trigger device 206 includes a laser (e.g., an infrared laser, a visible laser, etc.) to determine whether a user is holding the barbell 202. In some implementations, multiple technologies can be used in concert to determine whether the user is holding the barbell. In some implementations, the trigger device is not attached to the barbell. More implementations of trigger devices are discussed further below.

The locking features 208 can include receivers that receive signals (e.g., wirelessly, through a wired connection) from the trigger device 206. The locking features can lock or unlock depending on the signals received from the trigger device 206. A variety of signaling methodologies can be employed. For example, the locking features can unlock upon receiving a signal from the trigger device 206, and the locking features can lock when the receivers stop receiving the signal from the trigger device 206. In some implementations, the locking features can lock upon receiving a signal from the trigger device 206, and the locking features can unlock when the receivers stop receiving the signal from the trigger device 206. In some implementations, the locking features can unlock upon receiving a first signal from the trigger device3 206, and the locking features can lock when the receivers receive a second signal from the trigger device 206.

In some implementations, the locking features can communicate with each other (e.g., through a wired connection, Bluetooth, Wi-Fi, ZigBee, etc.). For example, if one locking feature is receiving the signal from the trigger device but the second locking feature is not receiving the signal, both locking features can lock, e.g., because the second locking feature can communicate to the first locking feature that no signal is being received. In some implementations, the locking features can communicate with each other such that if one locking feature is receiving the signal from the trigger device but the second locking feature is not receiving the signal, neither locking feature locks.

The weightlifting safety system 200 includes two ropes 210 that can hold the barbell when the locking features are locked. The ropes 210 can include, e.g., kernmantle ropes. Various types of flexible structures (e.g., cords, cables, chains, composite materials, etc.) can be used in addition or alternatively to ropes. More or fewer ropes (e.g., one rope, three ropes, four ropes, etc.) can be used. For clarity, one side of the safety system is described, but the other side of the safety system can work similarly. A rope 210 extends from a storage component 212 (e.g., a retractor, retractor reel, etc.) through the locking feature 208 (and potentially other components, e.g., pulleys, wheels, etc.) and attaches to the barbell 210. The storage component 212 provides constant tension to the rope 210. The tension provided by the storage component can be small enough to allow the weight to move freely. The tension provided by the storage component can also be large enough that the rope is not loose, such that when the user locks the locking feature 206 (e.g., by operating the trigger device 204) the rope 208 holds the weight 202 and maintains the position of the weight 202. This allows a user to safely step away from the weight 202 while the rope 208 holds the weight 202 in place. In some implementations, more or fewer storage components and locking features can be used. For example, in implementations with one rope, one storage component and one locking feature can be used.

The weightlifting safety system 200 include one or more power sources (e.g., a battery 214) to power electronics (e.g., the locking feature) of the system 200. In some implementations, the safety system 200 can be connected to an external power source to power the electronics of the system 200. The safety system 200 can be configured such that the locking feature 206 locks automatically upon losing power (e.g., depletion of the battery 214). For example, the locking feature 206 can require power to remain unlocked, and upon losing power the locking feature 206 automatically locks. This can provide safety for the user because the user can step away from the weight 202 when the system 200 loses power (e.g., during a power outage, upon depletion of the battery 214, etc.). In some implementations, the safety system 200 can include an indicator that a user when the battery is low on power. For example, the indicator can include, e.g., a light source, a speaker, etc. and the alert can be a visual alert, an audible alert, etc. This provides a user with information about the power status of the system 200.

In some implementations, the safety system 200 can include a number of data systems to collect, store, retrieve, analyze (e.g., predictive analytics), and distribute processed data (e.g., user data) which can be provided to the user to improve training. For example, user data can be used to generate personalized reports for the user. User data can also provide predictive analytics for future training. User data can also be used to provide training recommendations (e.g., increasing weight, decreasing weight, changing lift, etc.) for the user. For example, to collect data, the safety system 200 can include rotary position encoders, force sensors, voltage sensors, potentiometers, processors, etc. The safety system 200 can include a computer system 220 that can collect, analyze, and distribute user data. The safety system 200 can also include a smartphone 250 that can collect, analyze, and distribute user data. In some implementations, applications can be executed on a smartphone 250 to perform a number of functions. For example, user can access, share, etc. his or her data using the smartphone 250. In some implementations, other devices (e.g., smart watches, smart devices, etc.) can be used to collect, analyze, and distribute user data. In some implementations, the computer system 220, the smartphone 250, etc. can connect to the internet and, e.g., the internet of things (IOT). The IOT can include groups of objects with sensors, processing ability, software and other technologies that connect and exchange data with other devices and systems over the Internet, other communications network techniques, etc.

Figure 6:
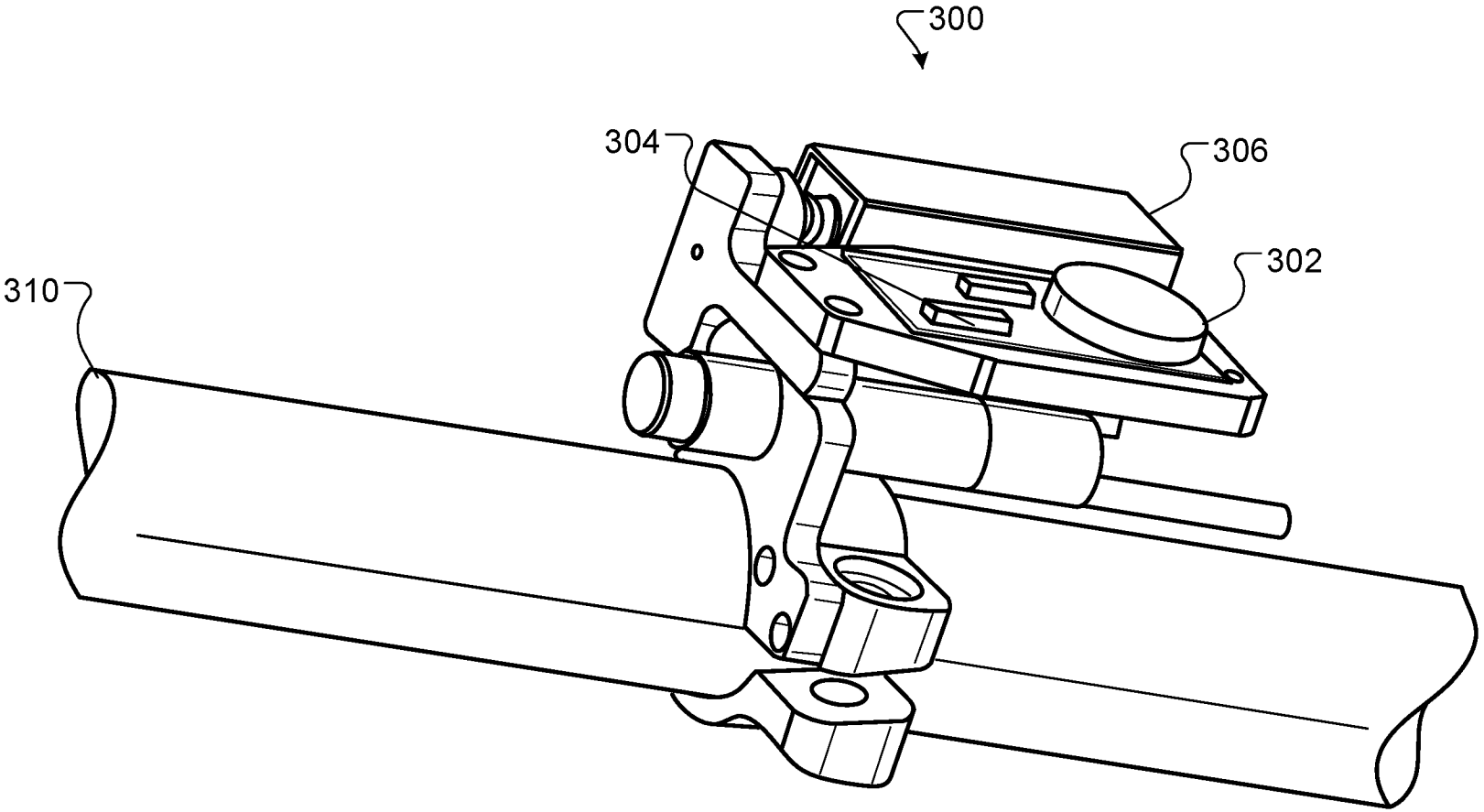
FIG. 6 is a perspective view of a trigger device for locking and unlocking a locking feature of a weightlifting safety feature.

FIG. 6 illustrates a trigger device 300 that is operable for a user to lock or unlock a safety system. For example, the trigger device 300 is one implementation that can be operable to lock or unlock the safety system 100 of FIG. 1. The trigger device 300 is attached to a bar 310. The trigger device 300 can detect whether a user is holding the bar 310. When the trigger device senses that the user is holding the bar 310, the trigger device 300 sends a signal (e.g., a wireless signal) to other components of the safety system that lock the bar in place.

Various types of mechanisms can be used in the trigger device 300. For example, the illustrated trigger device 300 includes a mechanical push button, but other types of technologies (e.g., magnetic, electromagnetic, etc.) can be implemented. The trigger device 300 includes a push button 302 and a transceiver 304 that is in communication with the push button to transmit signals to a safety system (e.g., a locking feature of a safety system). The trigger device 300 also includes a power source. The power source is illustrated as a battery 306, but various types of power sources may be employed (e.g., a wire for a wall socket, multiple batteries, etc.). When the user presses the push button 302, the transceiver 304 sends a signal (e.g., a wireless signal, a wired signal, etc.) to the safety system to unlock the locking feature of the safety system. When the user releases the push button 302, the transceiver 304 stops sending the wireless signal to the safety system. The locking feature of the safety system can lock when the transceiver 304 stops sending the signal to unlock the locking feature. That way, the user can simply release the push button 302 and step away from the weight 310, and the weight 310 maintains its position. Also, if the power source (e.g., the battery 306) runs out of power, the transceiver 304 stops sending the signal and the locking feature can lock.

Different signaling methodologies can be used for the trigger device 300 to communicate with the safety system (e.g., the locking feature of the safety system). For example, in some implementations, the signaling can be reversed. The transceiver sends a signal to the safety system to lock the safety system. When the user presses the push button 302, the transceiver 304 stops sending the signal to the safety system. The locking feature of the safety system can unlock when the transceiver 304 stops sending the signal to lock the locking feature.

Different technologies can be employed to sense when the user is holding the bar 310. For example, multiple technologies can be used in concert to sense when the user is holding the bar 310. In some implementations, redundant technologies can be used to reduce errors in the communication between the trigger device and the locking feature of the safety system. In some implementations, the trigger device 300 can include other sensors, e.g., a proximity sensor, a laser, etc. For example, a proximity sensor can be used in addition to or alternatively to the push button 302. The proximity sensor can sense when a user places his or her hands near the proximity sensor, and the transceiver can send a signal to unlock the safety system. In some implementations, a laser can be emitted from the trigger device 300. When the user places his or her hand over the laser, the transceiver can send a signal to unlock the safety system. In some implementations, multiple trigger devices can be positioned on a weight. For example, multiple trigger devices can be used so that a user can place both hands on the weight to unlock the safety system. In some implementations, the trigger devices can be moveable along the weight (e.g., the positions of the trigger devices on the weight can be moveable).

In some implementations, the trigger device may not be connected to the weight and it can be located elsewhere. For example, the trigger device can be included in a wearable device that the user wears while using the safety system. The trigger device can be included in, e.g., a pair of gloves, a single glove, a wristband, sweatband, etc. When the user grabs the weight while wearing the gloves (or other wearable device), the transceiver can send a signal to unlock the safety system. In some implementations, other types of external triggers (e.g., a foot pedal) can be used to send a signal to unlock the safety system. Various other types of trigger devices are possible. For example, optical technologies (e.g., computer vision) can be implemented so that visual signals (e.g., closing eyes, strained face, etc.) can cause the trigger device to send signals to lock the locking feature. Auditory technologies can also be implemented so that auditory signals (e.g., a scream for help, a voice command, etc.) can cause the trigger device to send signals to lock the locking features. For example, artificial intelligence (AI) systems can be implemented to recognize a detection event (e.g., a strained face, closed eyes, a scream for help, etc.) and cause the trigger device to send signals to lock the locking features. Such AI systems can be taught to recognize detection events that will thereby initiate a trigger, e.g., through machine learning. In some implementations, acceleration sensors (e.g., accelerometers) can be implemented so that sudden movements (e.g., sudden horizontal movement when someone bumps into the user, a sudden vertical movement when the user's muscles give out, etc.) cause the trigger device to send signals to lock the locking features. In some implementations, force sensors can be implemented to determine how hard the user is squeezing the weight and can cause the trigger device to send signals to lock the locking features (e.g., when a user is exerting too much force, when a user suddenly loses grip of the weight, etc.). In some implementations, the trigger device can be triggered by a third party (e.g., a coach, trainer, spotter, etc.).

In some implementations, the trigger device can send signals to other devices, e.g., a smartphone (e.g., the smartphone 250 of FIG. 5). In some implementations, the trigger device can send signals to a computer system (e.g., the computer system 220 of FIG. 5). The signals sent by the trigger device can collected, stored, retrieved, and analyzed (e.g., through predictive analytics) to improve training.

Figure 7:
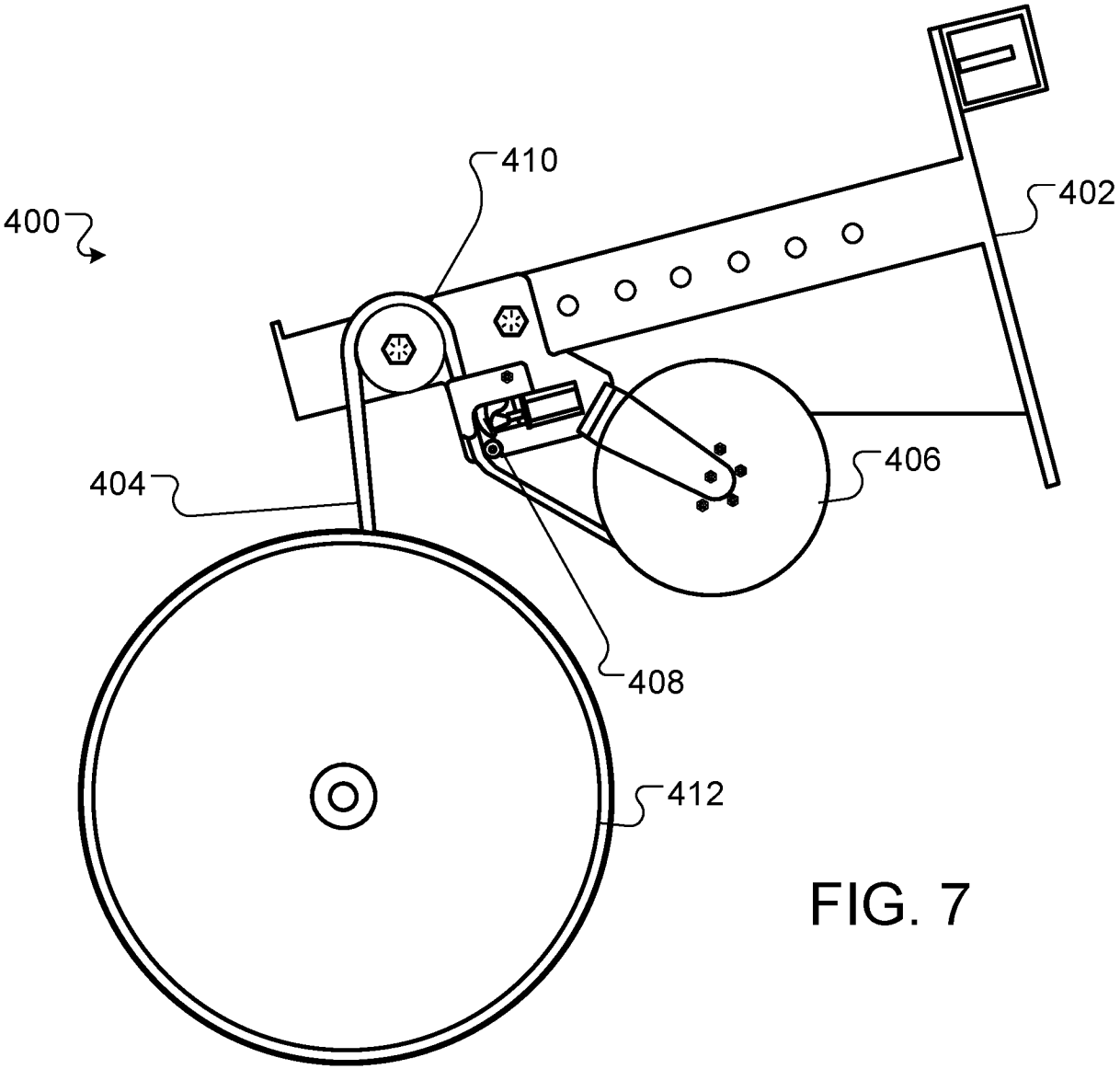
FIG. 7 is a side view of a weightlifting safety system.

FIG. 7 illustrates a side view of a weightlifting safety system 400. For example, the weightlifting safety system 400 can be similar to the safety system 100 of FIG. 1. The weightlifting safety system 400 can be designed to be easily added to a pre-existing mount 402 that is included in common fitness equipment (e.g., squat racks, gym racks, etc.) The mount 402 can also be used with, e.g., industrial equipment. This allows the user to install the weightlifting safety system 400 onto a variety of compatible sets of equipment. The weightlifting safety system 400 includes a rope 404 that extends from a storage component 406 through a locking feature 408 and over a pulley 410 to attach to a barbell and weight 412.

The storage component 406 provides constant tension to the rope 404. The tension provided by the storage component can have a relatively small level which allows the weight to move freely while the locking feature 408 is unlocked. The tension provided by the storage component can also be large enough that the rope is not loose, such that when the user locks the locking feature 408 the rope maintains the position of the barbell and weight 412 (e.g., without the barbell and weight 412 dropping). The storage component 406 can be, e.g., a retractor reel that is spring loaded to provide constant tension to the rope 404. In some implementations, other flexible structures (e.g., cords, cables, chains, composite materials, etc.) can be used in addition or alternatively to the rope 404.

The locking feature 408 locks to maintain the position of the barbell and weight 412. The locking feature can receive signals to lock or unlock, as described above. When the locking feature 408 is locked, the length of rope 404 extending from the locking feature 408 is fixed and holds the barbell and weight 412 so that a user can step away from the weight. When the locking feature 408 is unlocked, the barbell and weight 412 are free to move because the rope 404 is free to move through the locking feature 408 and can extend and retract from the storage component 406.

The rope 404 extends over a pulley 410 that is positioned between the locking feature 408 and the barbell and weight 412. The pulley 410 is used to redirect the rope 404 towards the barbell and weight 412. More or fewer pulleys can be implemented depending on the desired characteristics of the safety system 400. For example, the pulley 410 can be positioned differently, e.g., to direct the rope 404 in a different direction. The user may want to lift the barbell and weight 412 in a different fashion, and the pulley 410 may be better utilized in a different position. In some implementations, the pulley can be positioned between the storage component 406 and the locking feature 408.

Figure 8:
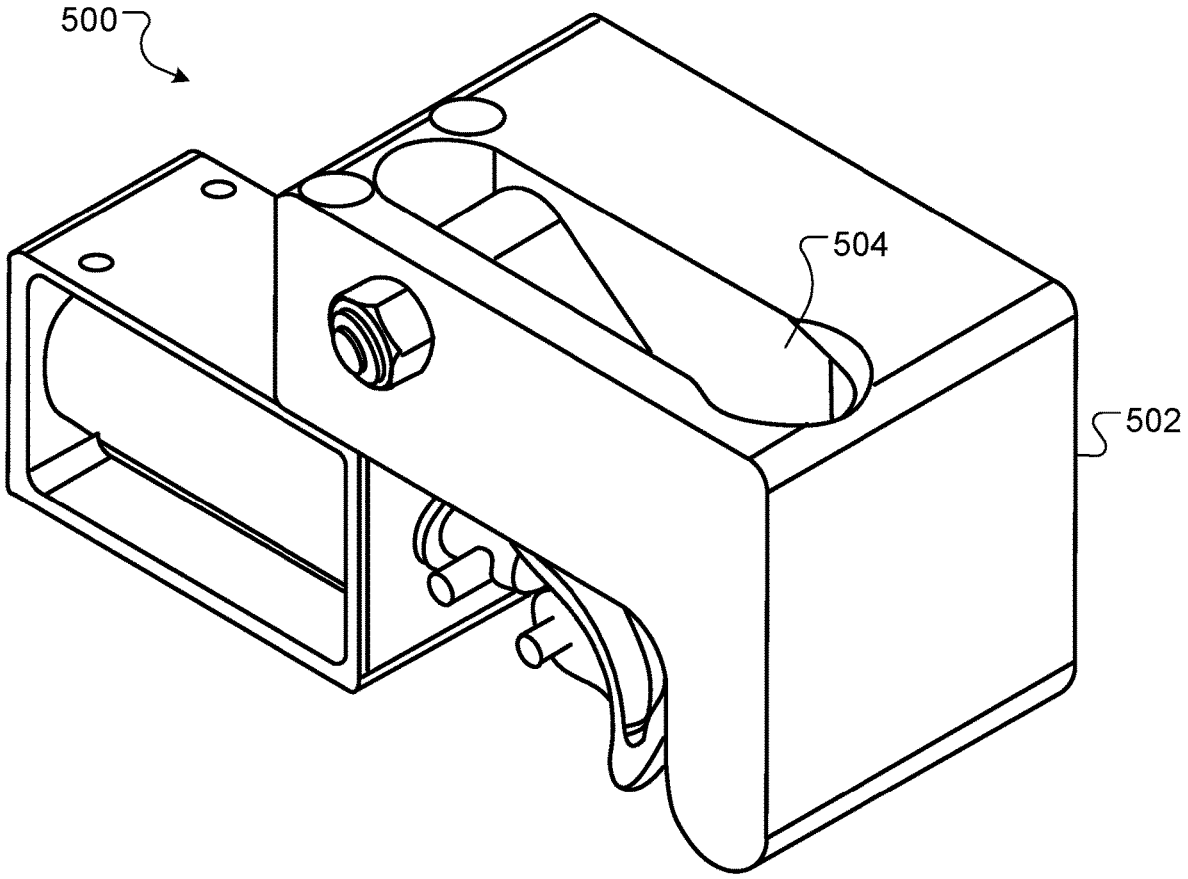
FIG. 8 is a perspective view of a locking feature of a weightlifting safety system.
Figure 9:
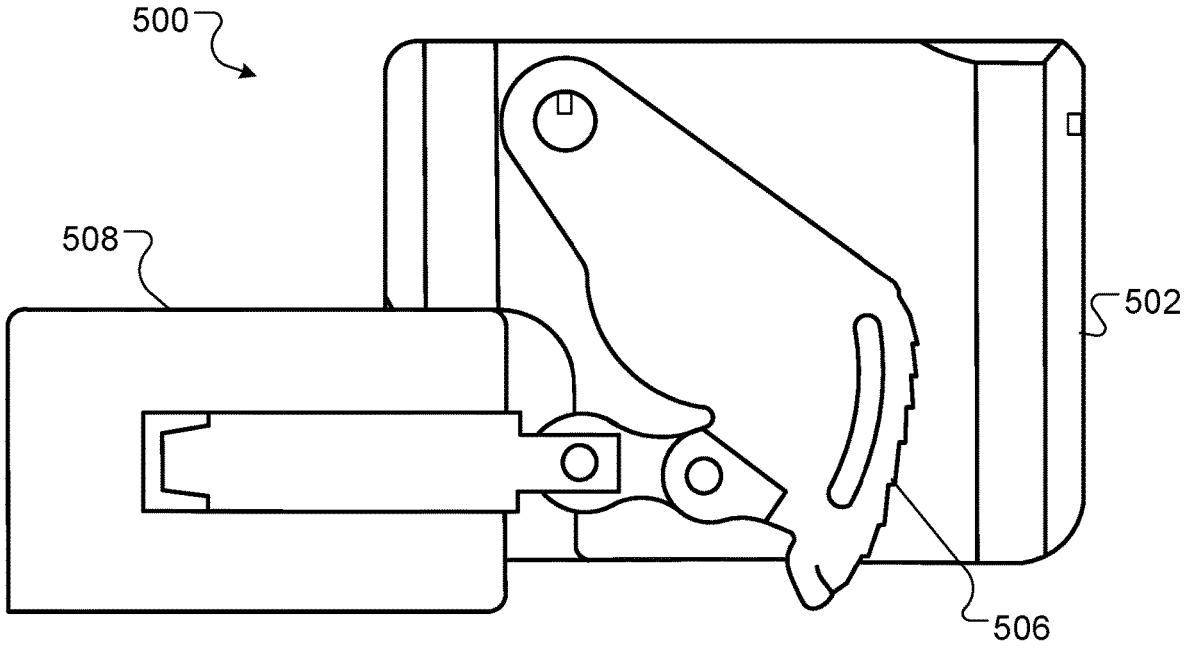
FIG. 9 is a side view of a locking feature of a weightlifting safety system.

FIGS. 8 and 9 respectively illustrate a perspective view of an exemplary locking feature 500 and a side view of the locking feature 500. For example, the locking feature 500 can be utilized in the safety system 100 of FIG. 1. The locking feature 500 can lock and unlock a rope to maintain the position of a weight (e.g., a barbell) as described above.

The locking feature 500 includes a mechanical rope lock having a housing 502 having an opening 504 through which a rope can extend. A locking face 506 is positioned inside the housing. The locking face 506 has a textured surface that increases friction between the locking face 506 and a rope. The textured surface can include, e.g., hooks or barbs that snag the rope. The locking face 506 extends outwards from an electric solenoid 508 positioned within the housing. The locking face 506 is biased away from the electric solenoid 508 when the electric solenoid is deactivated. When the locking feature is unlocked, the electric solenoid 508 retracts the locking face 506 so that the locking face 506 does not contact the rope. When the locking feature is locked, the electric solenoid extends so that the locking face 506 contacts the rope. The textured surface of the locking face 506 and the interior of the housing 502 lock (e.g., constrict) the rope and prevent the rope from sliding, moving, etc. Using the locking feature 500 to lock the rope in a weightlifting safety system allows the user to step away from the weight, as described above. In some implementations, the interior of the housing 502 can include a textured surface to increase the friction between the interior of the housing and the rope. In some implementations, the interior of the housing 502 is smooth to reduce the friction between the interior of the housing and the rope. This can be advantageous, e.g., because the rope is free to move smoothly while the locking feature is unlocked.

Figure 10:
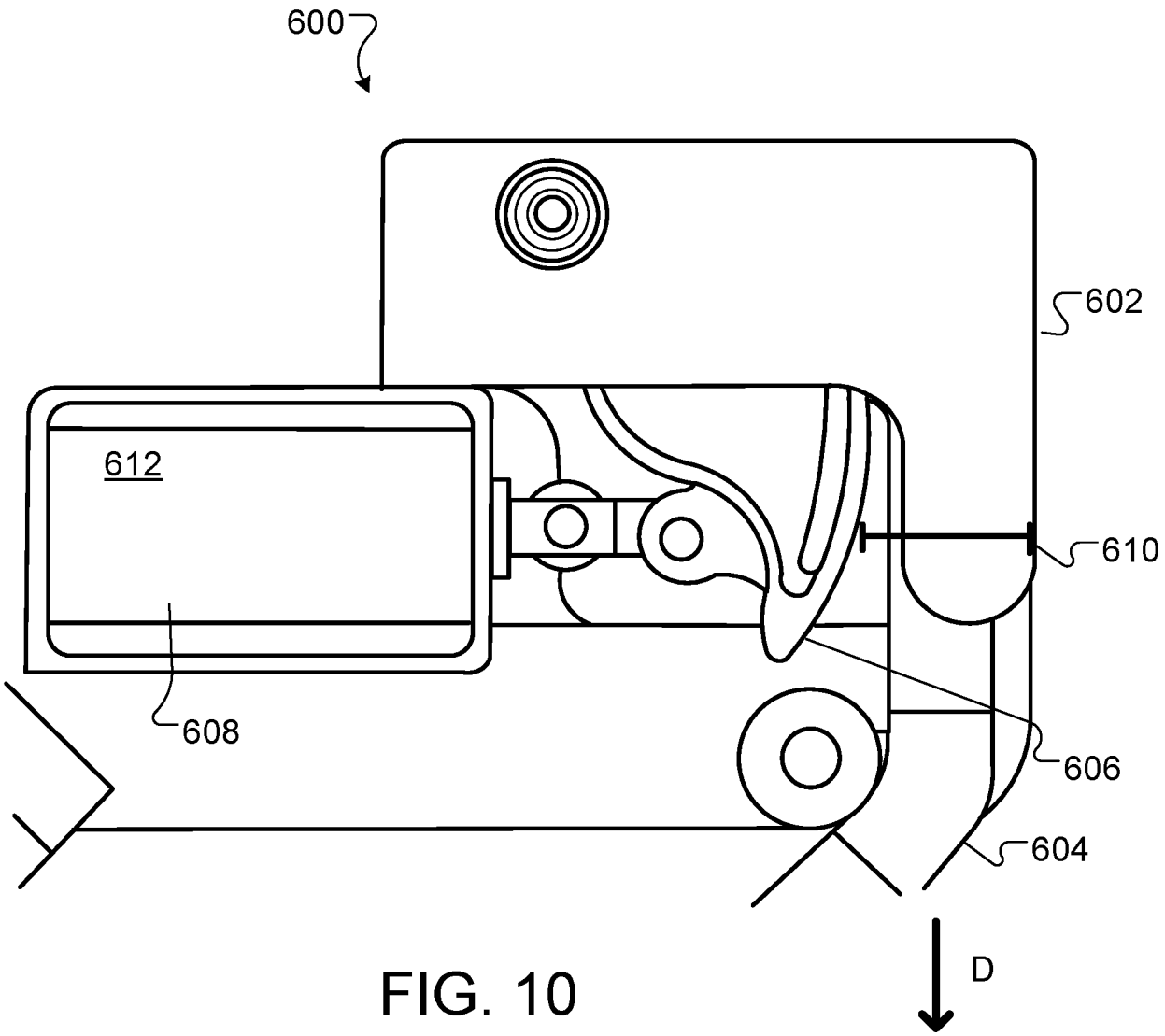
FIG. 10 is a view of a locking feature that is unlocked.
Figure 11:
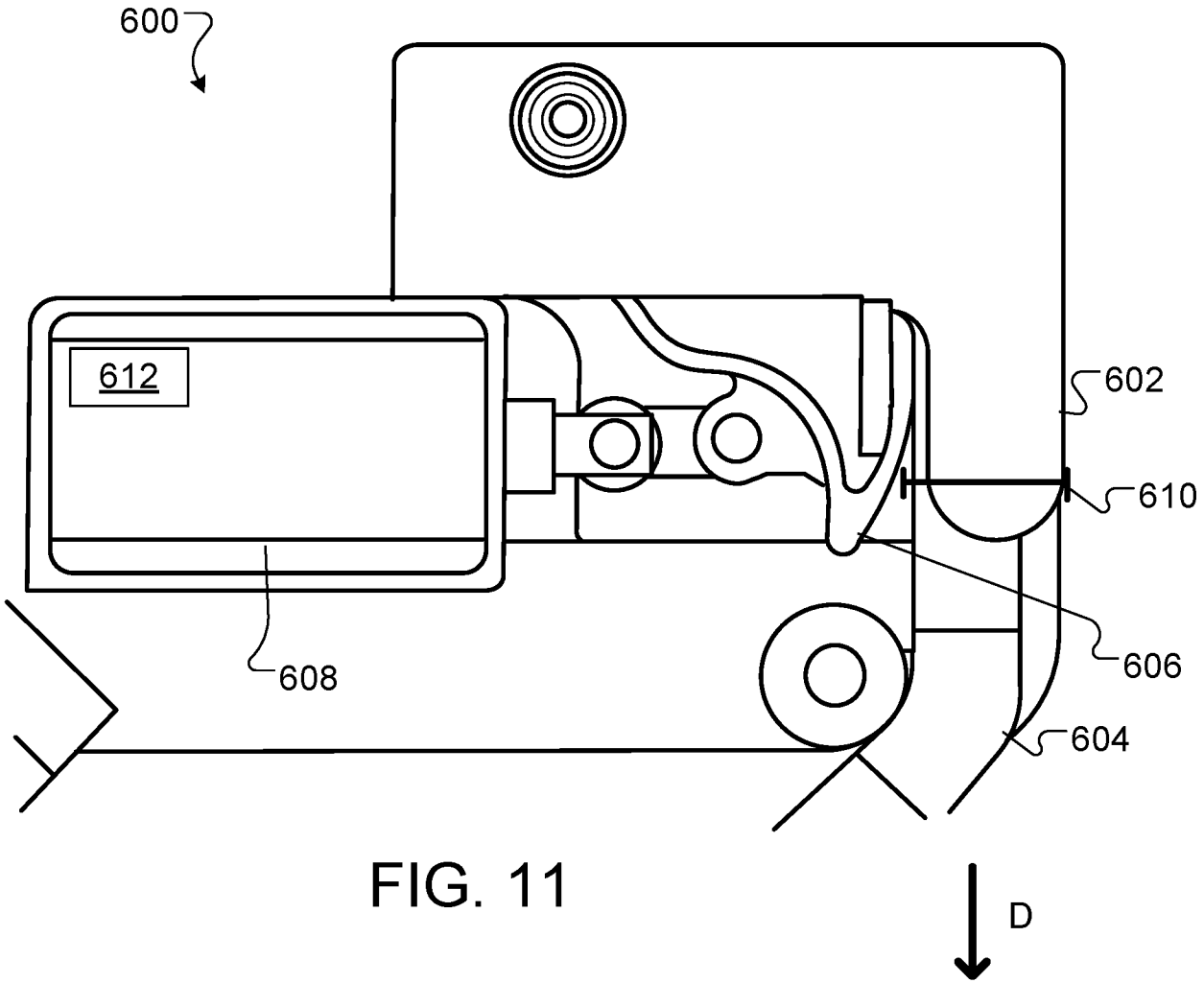
FIG. 11 is a view of a locking feature that is locked.

FIGS. 10 and 11 are views of a locking feature 600 while unlocked and while locked, respectively. For example, the locking feature 600 can be used in the safety system 100 of FIG. 1. The locking feature 600 can lock a rope in place while locked and can allow the rope to slide through the locking feature 600 while unlocked.

The locking feature 600 includes a mechanical rope lock having a housing 602 through which a rope 604 can extend. Positioned within the housing is a locking face 606 connected to an electric solenoid 608. The electric solenoid 608 can include a receiver 612 that receives signals to lock and unlock the locking feature 600. In FIG. 10, the locking feature is unlocked. The receiver receives signals to unlock the locking feature 600, so the electric solenoid 608 retracts the locking face 606 to increase the gap 610 between the locking face 606 and the housing 602. Increasing the gap 610 provides room for the rope 604 to move freely through the locking feature 600, e.g., without the rope 604 contacting the locking face 606.

In some implementations, a certain movement of the rope can unlock the rope 604 from the locking face 606 (e.g., the textured surface of the locking face 606) when the locking feature 600 is unlocked. For example, a movement of the rope in the direction D can free the rope 604 from the locking face 606 after unlocking the locking feature 600. This can provide additional safety when implemented in a weightlifting safety system. For example, to use the weights and the rope freely, a user needs to unlock the locking feature 600 (e.g., by sending a signal to unlock the locking feature 600) and also needs to move the weight in a predetermined direction (e.g., to free the rope 604 from the locking face 606). The predetermined direction can be a vertical movement upwards (e.g., when a vertical movement upwards moves the rope in the direction D). This can be advantageous because the user needs to be able to lift the weight before the rope is free to move through the locking feature. If the weight is too heavy for a user to lift, the rope can remain locked due to the textured surface of the locking face 606. In some implementations, the predetermined movement to unlock the locking feature can be a movement towards the locking feature. In other implementations, the predetermined movement to unlock the locking feature can be a movement in other directions (e.g., horizontally, at different angles, etc.).

FIG. 11 illustrates the locking feature 600 while locked, e.g., to lock a rope in place. The electric solenoid does not retract the locking face 606 (e.g., because the receiver is not receiving a signal to unlock the locking feature). The locking face 606 is biased away from the electric solenoid while the receiver is not receiving a signal to unlock the locking feature. This reduces the gap 610 between the locking face 606 and the interior of the housing 602. Reducing the gap 610 locks (e.g., constricts) the rope 604 between the locking face 606 and the interior of the housing 602 such that the rope 604 cannot move through the locking feature 600. When implemented in a weightlifting safety system, this allows the rope 604 to maintain the position of a weight so that a user can step away from the weight.

A number of embodiments have been described. Nevertheless, it will be understood that various modifications may be made without departing from the spirit and scope of the disclosure. Accordingly, other embodiments are within the scope of the following claims.

What is claimed is:

1. A weightlifting system comprising:

a locking device comprising a locking face controlled by an electric solenoid, wherein the electric solenoid is configured to cause the locking face to be moved from a closed position to an open position, the locking device further comprising a receiver configured to receive one or more signals to control the electric solenoid, a reel assembly that places tension on a flexible member, the flexible member being connected to the reel assembly and to a weight of the weightlifting system, wherein the flexible member extends through the locking device such that when the locking face is in the closed position, a length of the flexible member extending from the locking device is fixed; and a first trigger device connected to a first side of the weight of the weightlifting system, wherein the first trigger device is operable by a user to send a first signal to the receiver to unlock the locking device; and a second trigger device connected to a second side of the weight that is opposite the first side of the weight, wherein the second trigger device is operable by the user to send a second signal;

wherein the locking face is moved to the open position upon the receiver receiving the signal from the first trigger device and upon a movement of the weight of the weightlifting system, and wherein the movement of the weight allows travel of the flexible member from the locking face when the locking face is in the open position.

2. The weightlifting system of claim 1, wherein the first trigger device comprises a pushbutton operable to send the first signal to the locking device to unlock the locking device.

3. The weightlifting system of claim 1, wherein the first trigger device comprises an ultrasonic sensor operable to send the first signal to the locking device to unlock the locking device.

4. The weightlifting system of claim 1, wherein the first trigger device comprises a laser operable to send the first signal to the locking device to unlock the locking device.

5. The weightlifting system of claim 1, wherein the first trigger device comprises a proximity sensor operable to send the first signal to the locking device to unlock the locking device.

6. The weightlifting system of claim 1, wherein the locking device is a mechanical rope lock that comprises electric solenoid configured to unlock based upon the receiver receiving the first signal from the first trigger device.

7. The weightlifting system of claim 1, further comprising a power source configured to provide power to the locking device.

8. The weightlifting system of claim 1, wherein the first trigger device is operable to send the first signal to the receiver wirelessly.

9. The weightlifting system of claim 1, wherein the first trigger device is operable to send a third signal to lock the locking device.

10. The weightlifting system of claim 1, wherein the movement of the weight that unlocks the locking device is a vertical movement.

11. A weightlifting system comprising:

a barbell;

a mount operable to mount the weightlifting system;

a locking device comprising a locking face controlled by an electric solenoid, wherein the electric solenoid is configured to cause the locking face to be moved from a closed position to an open position, the locking device further comprising a receiver, the locking device positioned on the mount;

a flexible member that is connected to the barbell, wherein the flexible member extends through the locking device such that when the locking face is in the closed position, a length of the flexible member extending from the locking device is fixed;

a reel assembly positioned on the mount, wherein the reel assembly places constant tension on the flexible member;

a pulley positioned on the mount between the reel assembly and the locking device, wherein the flexible member extends from the reel assembly, around the pulley, and through the locking device;

a first trigger device connected to a first side of the barbell, wherein the first trigger device is operable by a user to send a first signal to the receiver to retract the electric solenoid and move the locking face from the closed position to the open position to unlock the locking device; and a second trigger device connected to a second side of the barbell that is opposite the first side of the barbell, wherein the second trigger device is operable by the user to send a second signal;

wherein the locking face is moved to the open position upon the receiver receiving the signal from the first trigger device and upon a vertical movement of the barbell, and wherein the movement of the weight allows travel of the flexible member from the locking face when the locking face is in the open position.

12. The weightlifting system of claim 11, wherein the first trigger device comprises a pushbutton operable to send the first signal to the locking device to unlock the locking device.

13. The weightlifting system of claim 11, wherein the first trigger device comprises an ultrasonic sensor operable to send the first signal to the locking device to unlock the locking device.

14. The weightlifting system of claim 11, wherein the first trigger device comprises a laser operable to send the first signal to the locking device to unlock the locking device.

15. The weightlifting system of claim 11, wherein the first trigger device comprises a proximity sensor operable to send the first signal to the locking device to unlock the locking device.

16. The weightlifting system of claim 11, wherein the second trigger device is operable by the user to send the second signal to the receiver to retract the electric solenoid and move the locking face from the closed position to the open position to unlock the locking device.

17. The weightlifting system of claim 11, further comprising a power source configured to provide power to the locking device, wherein the locking device is configured to remain locked upon a loss of power from the power source.

18. The weightlifting system of claim 11, wherein the first trigger device is operable to send the first signal to the receiver wirelessly.

19. The weightlifting system of claim 11, wherein the first trigger device is operable to send a third signal to lock the locking device.

20. The weightlifting system of claim 11, wherein the flexible member is a first flexible member connected to the first side of the barbell and the system further comprises a second flexible member extending through a second locking device and connected to the second side of the barbell that is opposite the first side of the barbell.

21. A weightlifting system comprising:

a locking device comprising a locking face controlled by an electric solenoid, wherein the electric solenoid is configured to cause the locking face to be moved from a closed position to an open position, the locking device further comprising a receiver, the locking device being operable to lock such that a first portion of a flexible member extending through the locking device is fixed from movement in a first direction; and a first trigger device positioned on a first side of a weight and operable by a user to send a first signal to the receiver to unlock the locking device such that the flexible member is free to move through the locking device; and a second trigger device connected to a second side of the weight that is opposite the first side of the weight, wherein the second trigger device is operable by the user to send a second signal;

wherein the locking face is moved to the open position upon the receiver receiving the first signal from the first trigger device and upon a predetermined movement in a second direction opposite the first direction of the flexible member through the locking device, wherein the predetermined movement allows travel of the flexible member from the locking face when the locking face is in the open position.

22. The weightlifting system of claim 21, wherein the first trigger device comprises a pushbutton operable to send the first signal to the locking device to unlock the locking device.

23. The weightlifting system of claim 21, wherein the first trigger device comprises an ultrasonic sensor operable to send the first signal to the locking device to unlock the locking device.

24. The weightlifting system of claim 21, wherein the first trigger device comprises a laser operable to send the first signal to the locking device to unlock the locking device.

25. The weightlifting system of claim 21, wherein the first trigger device comprises a proximity sensor operable to send the first signal to the locking device to unlock the locking device.

26. The weightlifting system of claim 21, wherein the locking device is a mechanical rope lock that comprises the electric solenoid configured to unlock based upon receiving the first signal from the first trigger device.

27. The weightlifting system of claim 21, further comprising a power source configured to provide power to the locking device.

28. The weightlifting system of claim 21, wherein the first trigger device is operable to send the first signal to the receiver wirelessly.

29. The weightlifting system of claim 21, wherein the first trigger device is operable to send a third signal to lock the locking device.

30. The weightlifting system of claim 21, wherein the second trigger device is operable by the user to send the second signal to the receiver to retract the electric solenoid and move the locking face from the closed position to the open position to unlock the locking device.

* * * * *